US005359397A

United States Patent [19]

Yamaji

[11] Patent Number: 5,359,397

[45] Date of Patent: Oct. 25, 1994

[54] DEVELOPING APPARATUS

[75] Inventor: Masaaki Yamaji, Yokohama, Japan

[73] Assignee: Canon Kabushiki Kaisha, Tokyo, Japan

[21] Appl. No.: 111,483

[22] Filed: Aug. 25, 1993

[30] Foreign Application Priority Data

Aug. 28, 1992 [JP] Japan ..... 4-254079

[51] Int. Cl.[5] ..... G03G 15/09

[52] U.S. Cl. ..... 355/251; 118/658; 335/303

[58] Field of Search ..... 355/245, 251, 253; 118/656–658; 335/296, 297, 303, 306

[56] References Cited

U.S. PATENT DOCUMENTS

| | | | |
|---|---|---|---|
| 4,580,121 | 4/1986 | Ogawa | 335/303 |
| 4,743,942 | 5/1988 | Yamamoto et al. | 118/657 X |
| 4,916,492 | 4/1990 | Hoshika et al. | 355/253 |
| 4,933,254 | 6/1990 | Hosoi et al. | 430/122 |
| 4,954,800 | 9/1990 | Ohtsuka | 335/303 X |
| 5,030,937 | 7/1991 | Loubier et al. | 335/303 |
| 5,051,782 | 9/1991 | Yamaji | 355/251 |
| 5,070,812 | 12/1991 | Yamaji | 118/658 |
| 5,129,357 | 7/1992 | Yamaji | 118/658 |
| 5,129,358 | 7/1992 | Myochin et al. | 118/658 |
| 5,212,344 | 5/1993 | Kageyama et al. | 118/658 |

FOREIGN PATENT DOCUMENTS

| | | | |
|---|---|---|---|
| 57-72162 | 5/1982 | Japan | 118/658 |
| 59-152469 | 8/1984 | Japan | 355/251 |
| 59-226367 | 12/1984 | Japan | 355/251 |

*Primary Examiner*—A. T. Grimley
*Assistant Examiner*—William J. Royer
*Attorney, Agent, or Firm*—Fitzpatrick, Cella, Harper & Scinto

[57] ABSTRACT

A developing apparatus for developing an electrostatic latent image formed on an image bearing member includes a developer carrying member for carrying a developer containing toner particles and magnetic carrier particles. The developer carrying member moves through a developing zone for applying the developer to the electrostatic latent image. A stationary magnet assembly is disposed in the developer carrying member. The magnet assembly comprises a rare earth magnet having a first magnetic pole for forming a magnetic field in the developing zone and a resin magnet having a second magnetic pole disposed adjacent to the first magnetic pole downstream of the first magnetic pole with respect to a movement direction of the developer carrying member, wherein a maximum magnetic flux density on a developer carrying member provided by the first magnetic pole is larger than a maximum magnetic flux density on the developer carrying member by the resin magnet.

13 Claims, 6 Drawing Sheets

DEVELOPING APPARATUS

FIELD OF THE INVENTION AND RELATED ART

The present invention relates to a developing apparatus for developing an electrostatic latent image formed on an image bearing member, using a developer containing toner particles and magnetic carrier particles.

A developing apparatus for developing an electrostatic latent image using a developer containing toner particles and magnetic carrier particles, that is, a two component developer, is provided with a developer container for containing the developer, a developing sleeve in the form of non-magnetic cylindrical member rotatable in said developer container, and a magnet roller non-rotatably disposed in the developing sleeve and having a plurality of magnetic poles. A thin layer of the developer is formed on the developing sleeve and is carried thereon. A developing pole of the magnet roller is used to form a magnetic brush of the developer on the developing sleeve. The magnetic brush rubs the image bearing member in a developing zone to develop an electrostatic latent image on the image bearing member.

To improve the image quality, an oscillating voltage is applied to the developing sleeve as a developing bias voltage to prevent non-uniformity in the image, and to improve reproducibility of the halftone image.

In such a developing apparatus, the toner particles can be sufficiently supplied to the electrostatic latent image, and therefore, high density images can be formed.

On the other hand, in order to provide a high resolution developed image, it is desirable to use small particle size toner particles and small particle size magnetic carrier particles. Then, however, the magnetic confining force of the magnetic carrier particles relative to the developing sleeve is reduced, and easily results in deposition of the carrier particles onto the image bearing member. In the developing apparatus, the density of the developer magnetic brush is low in the developing zone, and therefore, the image exhibits roughness in the low density region. If magnetic carrier particles having small saturation magnetization are used, therein the density of the magnetic brush in the developing zone can be improved, and therefore, roughness in the low density region can be prevented. Then, the magnetic confining force of the magnetic carrier particles relative to the developing sleeve is reduced, resulting in an increased tendency of carrier particle deposition onto the image bearing member.

Carrier deposition means a phenomenon in which the carrier particles are deposited onto the image bearing member. When the carrier particles are deposited onto the image bearing member, an air gap is produced between the transfer material and the image bearing member in the transfer operation, resulting in a reduced electric field in this region, and toner image transfer adjacent the carrier particles can become insufficient to such an extent that a part of the image is missing in the developed image. If the carrier particles are transferred onto the transfer material, they are not fixed on the transfer material. In addition, the toner particles adjacent the carrier particles may not be fixed, resulting in insufficient image fixing. If the non-fixed image is rubbed with something, then the unfixed image part will be removed from the image, and the transfer material will be contaminated. In addition, it is possible that the carrier particles could move during the fixing operation, resulting in a deteriorated image. If, on the contrary, the carrier particles deposited on the image bearing member remain on the transfer material without being transferred, then the image bearing member may be damaged when the carrier particles are removed by the cleaner, resulting in deteriorated image formation thereafter.

In the case of a two component developer, the toner particles and carrier particles are triboelectrically charged to the polarities opposite from each other. In other words, when the toner particles are charged to a positive polarity, the carrier particles are charged to a negative polarity. When the toner particles are charged to a negative polarity, the carrier particles are charged to a positive polarity. Therefore, when the toner is deposited on the image portion (portion to receive the toner) of the electrostatic latent image in the developing operation, the carrier particles tend to be deposited on the non-image portion (portion not to receive the toner). The carrier deposition is influenced by the difference between the potential of the non-image portion of the latent image and a DC component of the developing bias voltage applied to the developing sleeve, i.e., the contrast potential (Vb).

When the bias voltage contains only a DC voltage applied to the developing sleeve, the voltage Vb is applied between the non-image portion of the latent image and the developing sleeve. However, when the oscillating bias voltage is applied to the developing sleeve, the maximum voltage is $(\frac{1}{2})\times$(peak-to-peak voltage)$+$Vb, and therefore, carrier deposition tends to occur more easily. The oscillating voltage application is effective to improve the image quality, but it increases the possibility of carrier deposition.

In order to prevent carrier deposition, it is needed that the magnetic attraction force for attracting the carrier particles on the developing sleeve is increased in the developing zone. A resin magnet is widely used as a magnet in a conventional developing sleeve because it has the following advantages: the weight thereof is small, it can be easily molded into a correct shape, and the cost is low. However, it is very difficult to provide a resin magnet with a magnetic field having a magnetic flux density sufficiently high to prevent carrier deposition.

SUMMARY OF THE INVENTION

Accordingly, it is a principal object of the present invention to provide a developing apparatus in which carrier deposition is effectively prevented.

It is another object of the present invention to provide a developing apparatus wherein carrier deposition is effectively prevented with simple structure.

It is a further object of the present invention to provide a developing apparatus of low cost capable of effectively preventing carrier deposition.

It is a yet further object of the present invention to provide a developing apparatus using small particle size magnetic carrier particles, in which carrier deposition is effectively prevented.

It is a yet further object of the present invention to provide a developing apparatus using magnetic carrier particles having small saturation magnetization, in which carrier deposition is effectively prevented.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
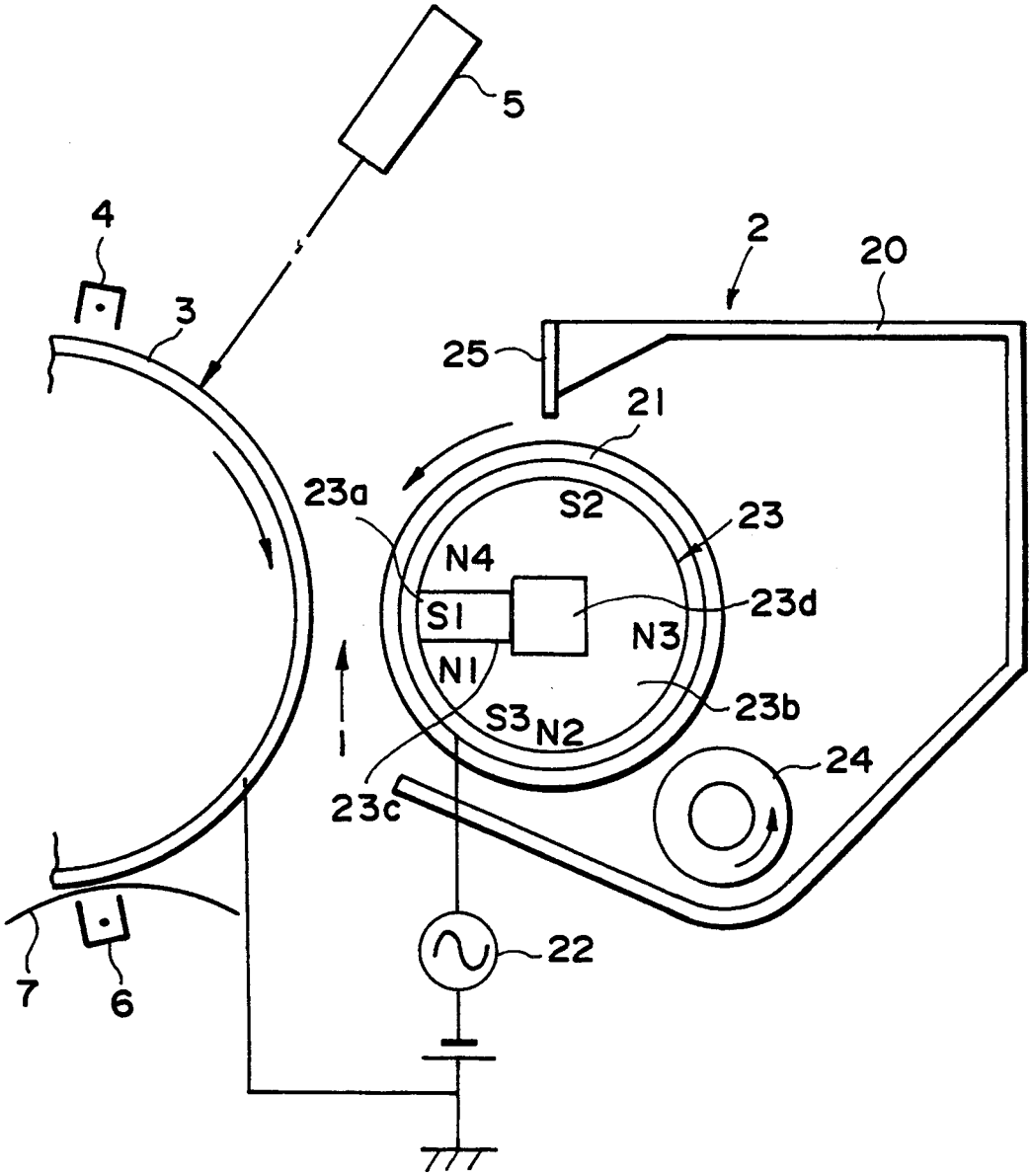
FIG. 1 illustrates an apparatus according to an embodiment of the present invention.

FIG. 1 is a sectional view of a developing apparatus according to a first embodiment of the present invention. An image forming apparatus having this developing apparatus includes an image bearing member in the form of an electrophotographic photosensitive drum 3. Around the photosensitive drum 3, there are provided, as known electrophotographic process means, a charger 4, an exposure optical system 5, a developing device 2, a transfer charger 6, a cleaning device (not shown) and a discharger (not shown), in the order named in the direction indicated by an arrow.

The photosensitive drum is uniformly charged to a predetermined polarity by the charger 4, image information light is projected through the optical system 5 onto the charged photosensitive drum 3, so that an electrostatic latent image is formed thereon. The optical system 5 is provided with a light source, preferably a semiconductor laser, which is driven in accordance with image signals to be recorded. The semiconductor laser is driven by pulse signals having a time length corresponding to the density of each of the pixels constituting the image. In other words, the semiconductor laser is driven by a driving signal which has been pulse-width-modulated. In any case, the optical system scans the photosensitive drum 3 with a laser beam thus produced. It is preferable that a portion to receive the toner, that is, the image portion, is exposed to the laser beam.

The electrostatic latent image thus formed is developed by a developing device 2. The developing device 2 causes the toner to be deposited on to the light potential portion of the electrostatic latent image, that is, the portion exposed to the laser beam. No toner is deposited on the dark potential portion of the electrostatic latent image. Thus, the electrostatic latent image is reverse developed.

The toner image formed on the photosensitive drum 3 by the developing operation, is transferred onto a transfer sheet 7 by a charger 6. The toner image transferred onto the transfer sheet 7 is fixed on sheet 7 by a known heat-fixing device (not shown).

The toner remaining on the photosensitive drum after the image transfer operation, is removed from the drum 3 by a known cleaning device (not shown), and thereafter, the drum 3 is electrically discharged by a known charging device (not shown).

The developing device of this embodiment comprises a developing sleeve 21 of non-magnetic material such as aluminum, stainless steel or the like, as a developer carrying member, in an opening of a developer container 20 for containing two component developer comprising non-magnetic toner particles and magnetic carrier particles. The developing sleeve 21 rotates in the direction indicated by an arrow to feed out developer from the container 20 to a developing zone where the developing sleeve 21 is faced to the photosensitive drum 3. In the opening of the developer container 20, there is provided a regulating blade 25 made of a non-magnetic material and arranged with a small clearance from an upper part of the developing sleeve 21 to regulate a developer layer into a thin developer layer on the developing sleeve 21. The non-magnetic toner particles are electrically charged to the same polarity as that of the dark portion potential of the latent image by friction with the magnetic carrier particles.

For the sake of simplicity of explanation, the developer is omitted in the drawing.

The developer fed to the developing zone 1 on the developing sleeve 21 is formed into a magnetic brush in the developing zone 1. The magnetic brush brushes the photosensitive drum 3 which is rotating in the direction indicated by an arrow. In this manner, an electrostatic latent image formed on the photosensitive drum 3 is developed into a visualized toner image. In the developing operation, the developing sleeve 21 is supplied with a developing bias voltage in the form of an oscillating bias voltage provided by superimposing an AC voltage and a DC voltage, from a voltage source 22. The waveform of the oscillating bias voltage is rectangular, sine or the like.

The DC voltage component of the oscillating bias voltage is between the light potential and the dark potential of the latent image. The dark portion potential and the light portion potential of the latent image is between the maximum and the minimum of the oscillating bias voltage.

In the developing sleeve 21, a stationary magnet roller 23 is disposed. The surface of the magnet roller 23 is provided with four N poles N1, N2, N3 and N4 and three S poles S1, S2 and S3. Of these magnetic poles, pole S1 functions as a developing magnetic pole, and is disposed corresponding to the developing zone 1 to form a magnetic field extending in a direction normal to the peripheral surface of the sleeve 21 in the developing zone. A magnetic brush of the developer is formed by the magnetic field, and is contacted to the drum 3. The magnetic pole S2 cooperates with the regulating blade 25 to regulate the layer thickness of the developer on the developing sleeve 21 (regulating pole). The magnetic poles N4, N1 and S3 are effective to convey the developer on the developing sleeve 21. The magnetic pole N1 is effective to move the developer existing in the developing zone 1 downstream with respect to the rotational direction of the sleeve.

The developer on the developing sleeve 21 having passed through the developing zone 1 is removed from the developing sleeve 21 by a repelling magnetic field formed between the magnetic poles N2 and N3 having the same magnetic polarity. The developer removed from the developing sleeve.21 is mixed and stirred with the developer in the container by a stirring screw 24 in a developer container 20, and the mixed developer is returned onto the developing sleeve 21 by the magnetic pole N3. The developer on the developing sleeve 21 is conveyed into the developing zone by way of the magnetic poles S2 and N4.

The magnet roller 23 comprises a resin magnet 23*b* in the form of a column having a recess 23*c* and a rare earth magnet 23*a* in the form a rectangular parallelepiped shape. The rare earth magnet 23*a* is embedded in the recess 23*c*. The magnetic pole S1 is formed in the rare earth magnet 23*a*, and the magnetic poles N1, N2, N3, N4, S2 and S3 are formed in the resin magnet 23*b*. Designated by a reference 23*d* is a shaft for supporting the magnet roller 23, and is securedly fixed to side walls of the container 20 (not shown).

As described in the foregoing, in order to prevent deposition of carrier particles, it is desirable to form a high magnetic flux density magnetic field in the developing zone 1. However, it is difficult to use a resin magnet to form a magnetic field having a magnetic flux density high enough to prevent such carrier deposition onto the drum 3, when magnetic carrier particles having a small particle size and having a low saturation magnetization are used. However, the use of the rare earth magnet easily provides for formation of a magnetic field having such a high magnetic flux density. However, regarding the other magnetic poles other than the developing magnetic pole, such a strong magnetic field formation is not required. Therefore, if the entirety of the magnet roller 23 is made of a rare earth magnet, then the rare earth magnet is used wastefully, and the weight thereof increases, and in addition, the cost is increased.

As described in the foregoing, it is satisfactory if the other magnetic pole other than the developing magnetic pole is capable of providing a magnetic field weaker than the magnetic field formed by the developing magnetic pole. Therefore, the other magnetic poles are formed in the resin magnet 23*b*, and only the developing magnetic pole S1 is formed in the rare earth magnet 23*a*. By doing so, the magnet roller becomes low in cost and weight despite the fact that it efficiently prevents carrier deposition.

Examples of materials usable for the rare earth magnet 23*a*, include samarium (Sm)-cobalt (Co) magnet, neodymium (Nd)-iron (Fe)-boron (B) magnet, and a magnet comprising at least one of samarium, neodymium or other rare earth materials. An example of the resin magnet comprises magnetic material powder of non-rare-earth metal dispersed in thermoplastic resin binder such as a polyamide resin material or a rubber binder. The magnetic material powder to be dispersed in the binder may be ferrite powder or the like.

It is preferable that the maximum of the magnetic flux density of the magnetic field in the direction perpendicular to the surface of the sleeve formed by the developing magnetic pole S1 is 1500–2500GAUSS, and it is preferable that the maximum magnetic flux densities of the magnetic field in the direction perpendicular to the sleeve surface formed by the other magnetic poles N1, N2, N3, N4, S2 and S3, are 400–1400 Gauss. The above magnetic flux density values are those on the peripheral surface of the sleeve.

On the other hand, it is preferable that the insulative non-magnetic toner comprising coloring material and the resin binder, has a volume average particle size of not less than 4 microns and not more than 10 microns, from the standpoint of providing a high resolution developed image. In order to triboelectrically charge and properly mix with the non-magnetic toner, the magnetic carrier particles preferably have a weight average particle size of 25–80 microns, and further preferably 30–70 microns. The magnetic carrier particles may be in the form of a magnetic material such as ferrite and a thin resin coating therefor. In order to prevent production of roughness of the developed image in the low density region by increasing the density of the magnetic brush in the developing zone, the saturation magnetization of the magnetic carrier preferably is 30–80 emu/g.

The volume distribution and the volume average particle size of the toner are measured using an aperture of 100 μm in the following manner:

A Coalter Counter TA-II (Coalter Corporation) is used. To the counter, an interface (Nikkaki Kabushiki Kaisha, Japan) outputting a number average distribution and a volume average distribution, and CX-i personal computer (Canon Kabushiki Kaisha, Japan) are connected. Using an electrolyte e(first class natrium chloride), 1% NaCl water solution is prepared.

To the electrolyte solution (100–150 ml), 0.1–5 ml of surface active agent (dispersing agent) (preferably alkylbenzene sulfonate) is added. Further, 0.5–50 mg of the material to be tested is added thereto.

The electrolyte suspending the material is subjected to the ultrasonic dispersing treatment for approximately 1–3 min. Using an aperture of 100 microns, the particle size distribution in the range of 2–50 microns is measured using the counter TA-II to obtain the volume distribution.

From the volume distribution obtained, the volume average particle size of the material is obtained.

The weight average particle size of the magnetic carrier is determined in the following manner. First, the particle size distribution of the carrier is determined.

(1) Approx. 100 g of the toner is measured to the order of 0.1 g.

(2) Sieves of 100 meshes, 145 meshes, 200 meshes, 250 meshes, 350 meshes and 400 meshes are overlaid in this order from the top, and are set on a saucer. The toner is placed on the top sieve, the inside diameter of the sieves above the mesh is 200 mm, and the depth from the top to the mesh is 45 mm.

(3) A shaking table carrying the sieves is actuated for 15 sec with a horizontal whirling of 285±6 per min. and a frequency of 150±10 per min.

(4) The weights of the toner powders remaining on the respective sieves are measured to the order of 0.1 g.

(5) The weight percentage to the order of the second decimal fraction is calculated, and the results are recorded to the first decimal fraction order according to JIS-Z8401. The total of the weights must not be less than 99% of the originally obtained weight.

The weight average particle size is determined using the particle size distribution thus obtained, in the following manner:

{(100 mesh-on amount)×140
+(145 mesh-on amount)×122
+(200 mesh-on amount)×90
+(250 mesh-on amount)×68
+(350 mesh-on amount)×52
+(450 mesh-on amount)×38
+ all-mesh-pass amount ×17]×(1/100).

The amount of a carrier of the size less than 500 mesh is calculated from the weight reduction when 50 g of the carrier placed on 500 mesh standard sieve is sucked.

The saturation magnetization and the magnetic permeability of the magnetic carrier are measured using vibration type magnetometer (VSM-P-1, available from Toei Kogyo, Japan). The magnetization of the magnetic carrier particles placed in the magnetic field of 10,000 Oerested at the maximum, and the saturation magnetization and the magnetic permeability are determined on the basis of the hysteresis curve recorded on a sheet.

The minimum gap between the sleeve 21 and the photosensitive drum 3 in the developing zone 1 is 0.1 −0.8 mm, and the gap between the sleeve 21 and the doctor blade 25 is 0.2–1.2 mm, in a preferred example.

The description will be made as to an example of image formation. In this example, the electrostatic latent image formed on the photosensitive drum 3 had a dark potential (background potential) of −700 V and a light portion potential (image potential) of −200 V. The oscillating bias voltage applied to the developing sleeve 21 was −500 V DC voltage biased with an AC voltage having a frequency of 2 KHz and a peak-to-peak voltage Vpp of 2 KV. The peripheral speed of the photosensitive drum 3 was 160 mm/sec, and the peripheral speed of the developing sleeve 21 was 280 mm/sec. The minimum distance between the photosensitive drum and the developing sleeve was 0.5 mm. The gap between the developing sleeve and the regulating blade was 0.8 mm. The outside diameter of the photosensitive drum was 80 mm, and the outside diameter of the developing sleeve was 20 mm.

The toner of the two component developer used in this example is an insulative non-magnetic toner having a negative charging polarity and comprising resin material and coloring material. It had a volume average particle size of 8 microns. The magnetic carrier particle comprises a ferrite particle coated with thin resin material. It had the volume average particle size of 45 microns. The saturation magnetization of the carrier particles was approx. 60 emu/g, and the magnetic permeability thereof was approx. 5.0. Since the toner is of the negative charging polarity, the developing operation is a reverse type.

The resin magnet **23*b* of the magnet roller 23 comprises a binder of thermoplastic resin material and ferrite fine particles dispersed therein. The rare earth magnet 23*a*** was Nd-Fe-B magnet.

The maximum magnetic flux densities and the arrangements of the developing pole S1 and the conveying pole N1 of the magnet roller are as follows:

Developing magnetic pole Si: 2000 Gauss maximum magnetic flux density;

Conveying magnetic pole Ni: 1000 Gauss maximum magnetic flux density; and

Space between the poles S1 and N2: 40 degrees, as seen from a rotatable center of the sleeve.

Figure 2:
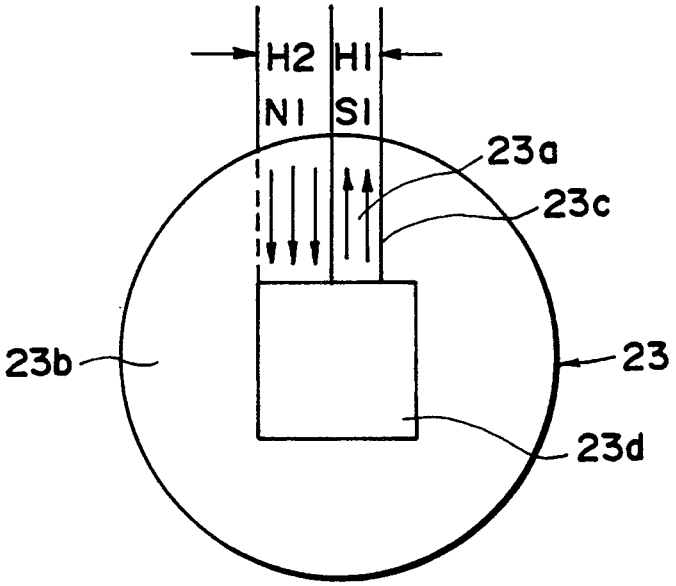
FIG. 2 illustrates a magnetic roller assembly used in the apparatus of FIG. 1.
Figure 3:
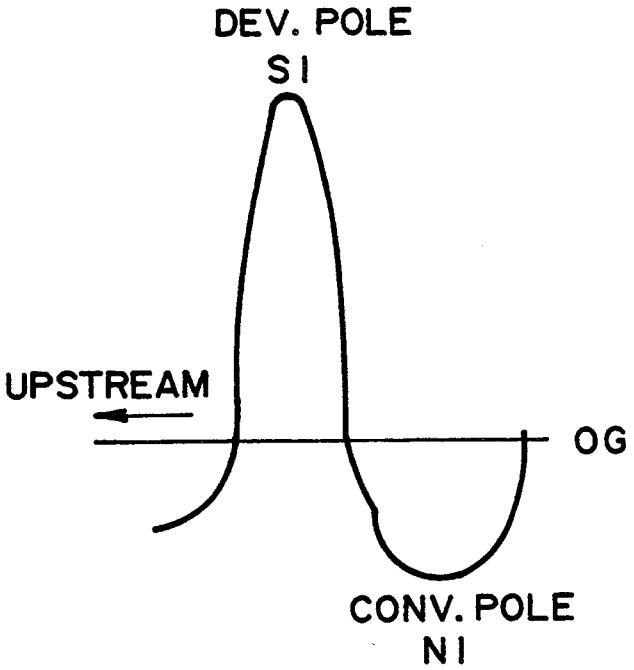
FIG. 3 illustrates magnetic flux density distributions of magnetic poles S1 and N1 of a magnet roller assembly shown in FIG. 2.

The rare earth magnet **23*a* having the developing pole S1 of the magnet roller 23 is in the form of a rectangular parallelepiped block having a magnetization width H1. As shown in FIG. 2, the magnetic field of the rare earth magnet 23*a* extends radially outwardly from the center of the magnet roller 23 (magnetization direction), and therefore, a strong magnetic force can be provided efficiently with the developing pole S1. The conveying pole N1 downstream of the developing pole S1 with respect to the rotational direction of the developing sleeve and adjacent to the developing magnetic pole S1, is formed in the resin magnet 23*b*, as described hereinbefore. The direction of the magnetic field provided by the pole N1 (the direction of the magnetization for the formation of the pole N1), as shown in FIG. 2, is directed in the opposite direction from the magnetization direction of the magnet 23*a*. By doing so, as shown in FIG. 3, the magnetic flux density distribution having a configuration smoothly bulging appears as continuing from the magnetic flux density distribution provided by the developing pole S1, so that flow-out of the developer from the developing zone 1** can be made smooth.

The magnetization width H2 of the conveying magnetic pole N1, as shown in FIG. 2, is larger than the magnetization width H1 of the developing pole S1. Therefore, despite the fact that the maximum of the magnetic flux density is smaller in the conveying pole N1 than in the developing pole S1, the developer is conveyed from the developing zone toward the conveying pole N1 in good order.

The image forming operation has been carried out under the above-described developing conditions, using the developing device of this example. The resultant image was free of carrier deposition, and the density thereof was high enough, and in addition, it did not exhibit the fog or image roughness.

Figure 4:
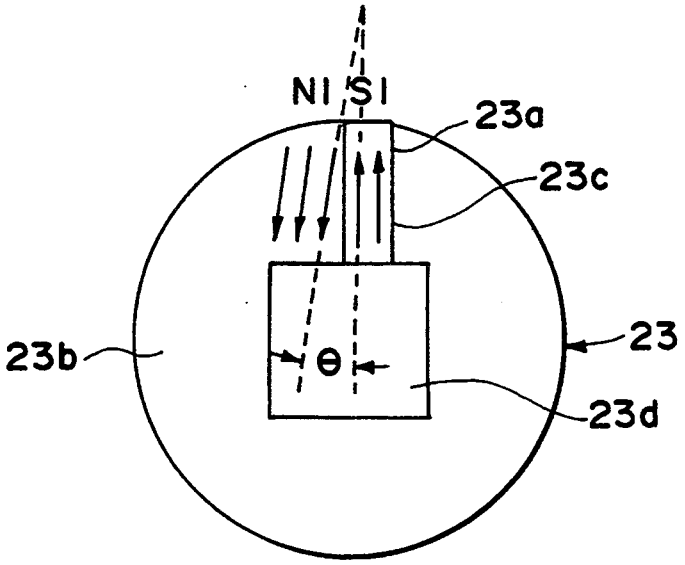
FIG. 4 illustrates a magnetic roller assembly according to another embodiment.
Figure 5:
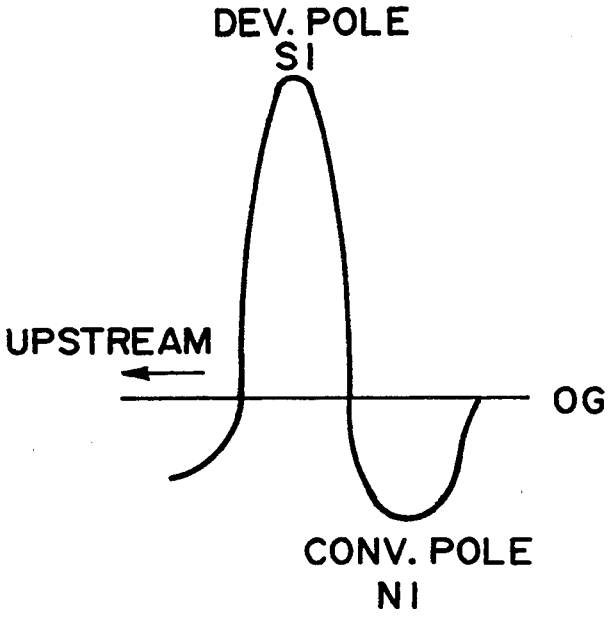
FIG. 5 illustrates magnetic flux density distributions of magnetic poles S1 and N1 of a magnet roller assembly of FIG. 4.

In order to properly convey the developer out of the developing zone 1, it is preferable that the direction of the magnetization for formation of the pole S1 is exactly the opposite from the direction of the magnetization for the pole N1, or that, as shown in FIG. 4, the angle formed between the two directions is open toward the inside of the magnet roller rather than toward the outside thereof. The angle $\theta$ indicated in FIG. 4 is preferably 0–30 degrees. By doing so, the magnetic flux density distribution provided by the pole S1 and the magnetic flux density distribution provided by the pole N1, are smoothly continued, as shown in FIG. 5, and therefore, the occurrence of carrier deposition can be effectively prevented, and simultaneously, the developer can be smoothly conveyed out from the developing zone toward the downstream side thereof.

Figure 6:
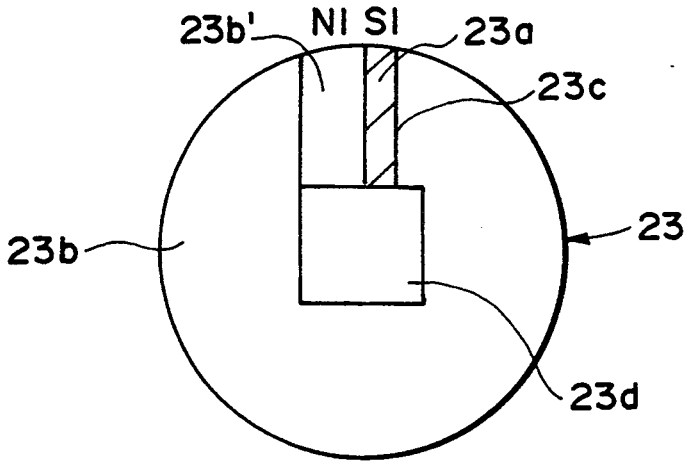
FIG. 6 illustrates a magnet roller assembly according to a further embodiment of the present invention.

The magnet roller 23 shown in FIG. 6 is provided with a magnetic pole N1 in a rectangular parallelepiped resin magnet **23*b*′, and the resin magnet 23*b*′ is embedded together with the rare earth magnet 23*a* into the recess 23*c* of the resin magnet 23*b*. In this manner, the magnetization direction for the formation of the pole N1** can be made further uniform.

An image forming operation has been carried out in the same condition as described in conjunction with the foregoing embodiment, and the resultant image was of high quality without carrier deposition or background fog.

Figure 7:
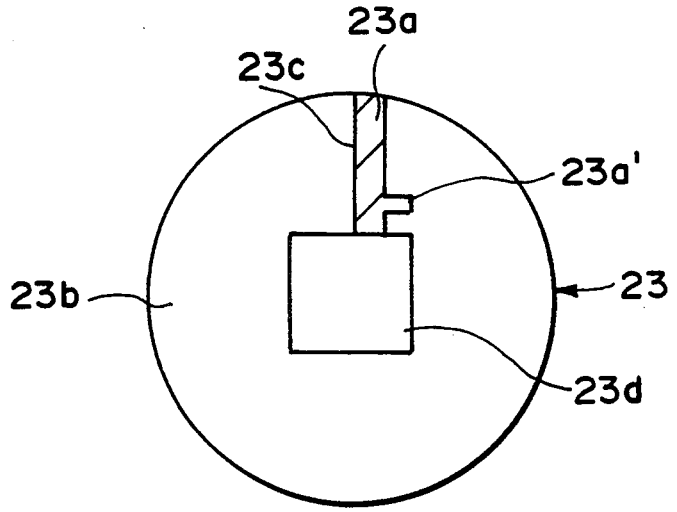
FIG. 7 illustrates a magnet roller assembly according to yet a further embodiment of the present invention.

Referring to FIG. 7, there is shown a magnet roller according to a further embodiment of the present invention. In this embodiment, a projection **23*a*′ is formed at the outside of the rare earth magnet 23*a*, and the resin magnet 23*b* has a complementary groove for receiving the projection 23*a*′. In this manner, the rare earth magnet 23*a* can be securedly fixed in the resin magnet 23*b* as well as the shaft 23*d* of the magnet roller 23, and therefore, the rare earth magnet 23*a* can be secured to the magnet roller 23** with high precision.

Figure 8:
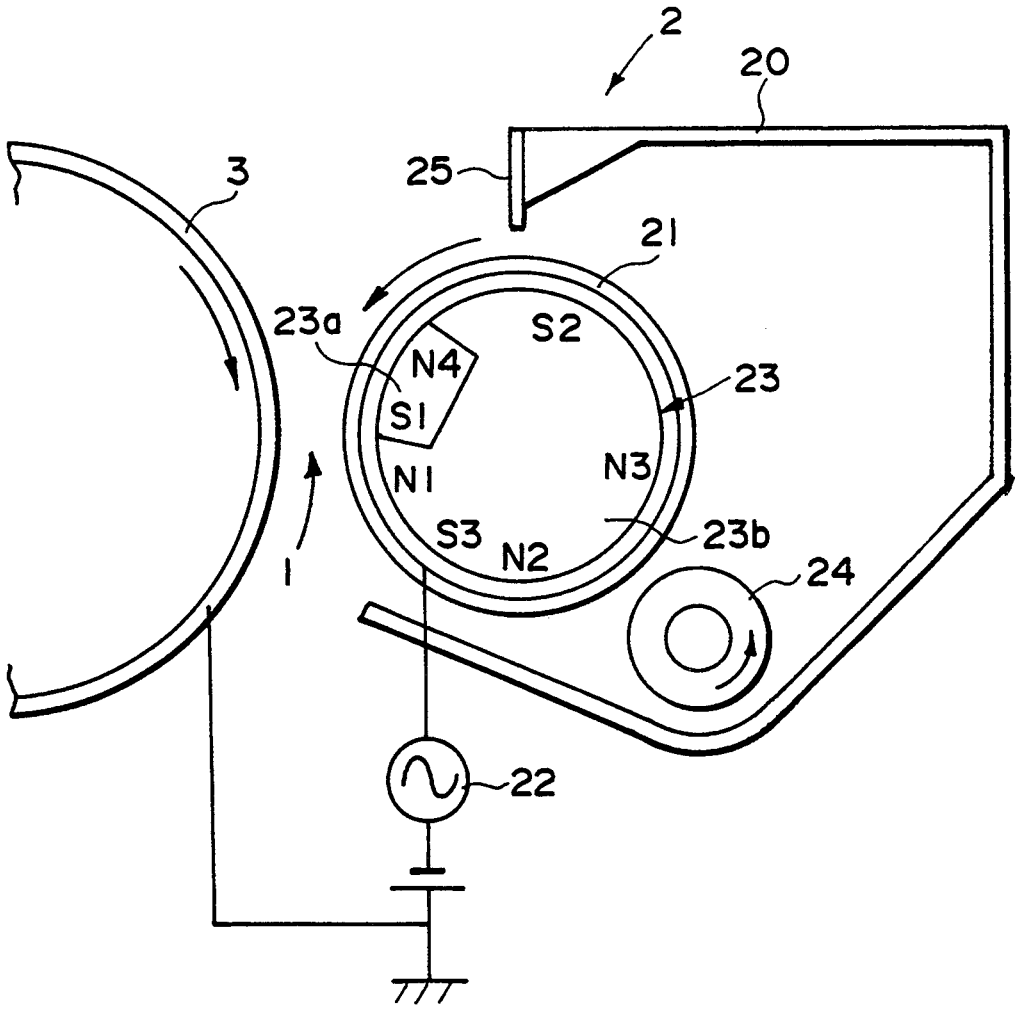
FIG. 8 illustrates a further embodiment.

Referring to FIG. 8, there is shown in cross-section a developing apparatus according to a further embodiment. The apparatus is characterized in that two poles N4 and S1 are formed in the rare earth magnet **23*a* in the magnet roller 23 inside the developing sleeve 21**.

The fundamental structure is the same as that of the FIG. 1 apparatus, and therefore, the detailed description is omitted for simplicity by assigning the same reference numerals as in FIG. 1 to the elements having the corresponding functions.

In the embodiment of FIG. 1, the N-S of the rare earth magnet 23*a* extends in the direction of the radius of the roller, wherein the S-pole S1 is formed adjacent the surface of the rare earth magnet 23*a*. In this embodiment, the N-S extends in the circumferential direction of the rare earth magnet 23*a*, by providing magnetic poles N4 and S1 adjacent the surface of the rare earth magnet 23*a*.

The magnetic flux densities and positions of the developing pole and conveying pole of the magnet roller are as follows:

Developing pole S1: 1700 Gauss maximum magnetic flux density;

Conveying pole N1: 1000 Gauss maximum magnetic flux density; and

Space between the poles S1 and Ni: 40 degrees, as seen from the rotational center of the sleeve.

An image forming operation has been carried out using this developing apparatus under the same condition as in the FIG. 1 embodiment. The resultant image was free from carrier deposition, and the density was high without fog or image roughness.

In the foregoing embodiments, the binder of the resin magnet 23*b* is thermoplastic resin such as Nylon. In one method, a dummy rare earth magnet 23*a* is disposed in a metal mold for the resin magnet 23*b*, and a rubber containing magnetic particles such as ferrite particles is injected, so that a rubber block containing the magnetic material is integrally molded. Then, it is magnetized to provide the resin magnet 23*b*. Subsequently, the rare earth magnet 23*a* is bonded, thus providing the magnet roller 23. In this alternative method, the magnet roller 23 can be manufactured at a further lower cost.

Figure 9:
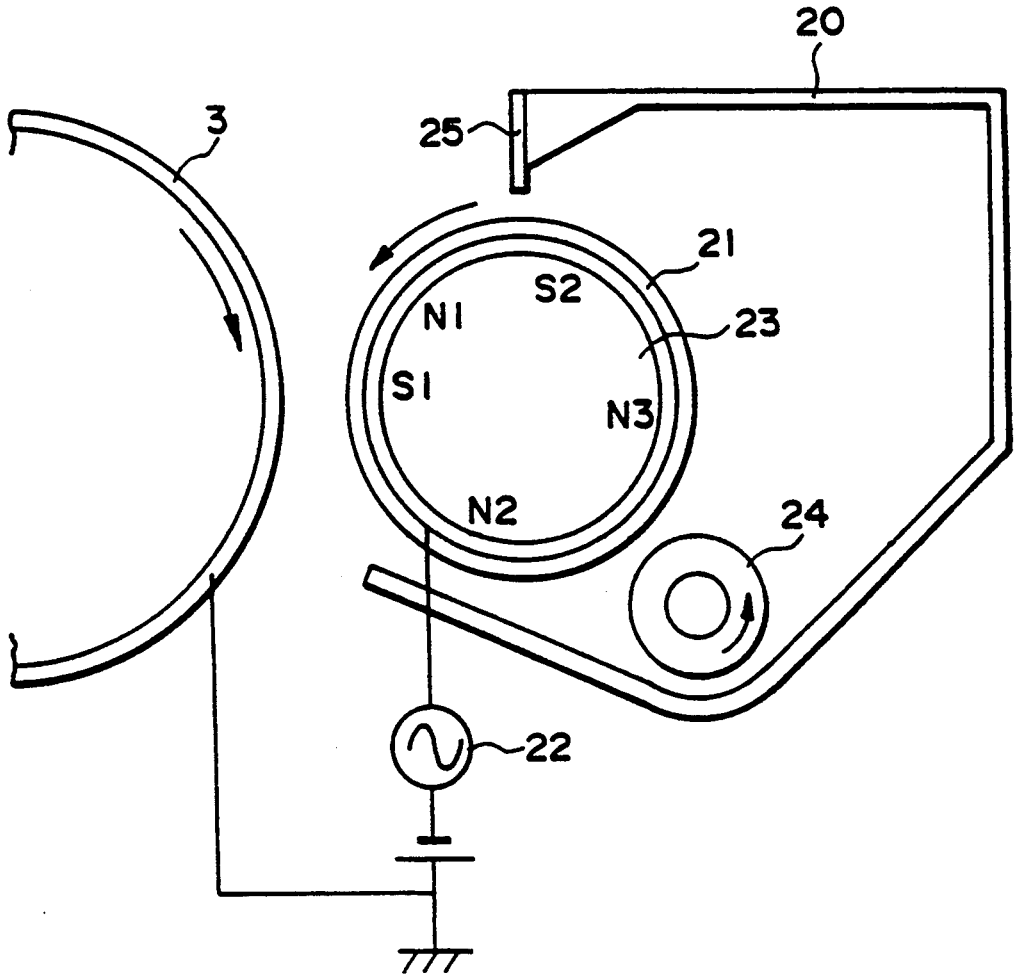
FIG. 9 PRIOR ART
FIG. 9 illustrates an example of a prior art structure.

Referring to FIG. 9, a prior art developing apparatus is shown. In this apparatus, the magnet roller 23 has five poles in the developing sleeve 21. The magnet roller 23 is entirely made of low cost resin magnet, in other words, the entirety of the magnet roller 23 is made of the same material.

In FIG. 9, the magnet roller 23 is magnetized such that the magnetic flux density of the pole S1 is 1000 Gauss; N2, 500 Gauss; and the space between the poles S1 and N2 is 80 degrees. A developing operation has been carried out similarly to the FIG. 1 embodiment, and as a result, the image quality was satisfactory, but carrier deposition occurred, and resulted in a missing portion in a transferred image.

While the invention has been described with reference to the structures disclosed herein, it is not confined to the details set forth and this application is intended to cover such modifications or changes as may come within the purposes of the improvements or the scope of the following claims.

What is claimed is:

1. A developing apparatus for developing an electrostatic latent image formed on an image bearing member, comprising:

a developer carrying member for carrying a developer containing toner particles and magnetic carrier particles, said developer carrying member moving through a developing zone for applying the developer to the electrostatic latent image;

a stationary magnet assembly disposed in said developer carrying member, said magnet assembly comprising a rare earth magnet having a first magnetic pole for forming a magnetic field in the developing zone and a resin magnet having a second magnetic pole disposed adjacent to the first magnetic pole downstream of the first magnetic pole with respect to a movement direction of said developer carrying member, wherein a maximum magnetic flux density on a developer carrying member provided by the first magnetic pole is larger than a maximum magnetic flux density on said developer carrying member by the resin magnet.

2. An apparatus according to claim 1, wherein said resin magnet is provided with a recess in which the rare earth magnet is embedded.

3. An apparatus according to claim 1 or 2, wherein said rare earth magnet comprises at least one of samarium (Sm) and neodymium (Nd).

4. An apparatus according to claim 1 or 2, wherein said resin magnet comprises a resin binder and ferrite particles dispersed therein.

5. An apparatus according to claim 3, wherein said resin magnet comprises a resin binder and ferrite particles dispersed therein.

6. An apparatus according to claim 1 or 2, wherein the second magnetic pole has a magnetization width which is larger than a magnetization width of the first magnetic pole.

7. A developing apparatus for developing an electrostatic latent image formed on an image bearing member, comprising:

a developer carrying member for carrying a developer comprising non-magnetic toner particles having a volume average particle size of 4–10 microns and magnetic carrier particles having a volume average particle size of 25–80 microns and having a saturation magnetization of 30–80 emu/g, said developer carrying member moving through a developing zone in which a layer of the developer on said developer carrying member is contacted to the image bearing member;

a stationary magnet assembly disposed in said developer carrying member, said magnet assembly comprising a rare earth magnet having a first magnetic pole for forming a magnetic field in the developing zone and a resin magnet having a second magnetic pole disposed adjacent to the first magnetic pole downstream of the first magnetic pole with respect to a movement direction of said developer carrying member, wherein a maximum magnetic flux density on a developer carrying member provided by the first magnetic pole is larger than a maximum magnetic flux density on said developer carrying member by the resin magnet; and voltage applying means for applying an oscillating developing bias voltage to said developer carrying member.

8. An apparatus according to claim 7, wherein a maximum magnetic flux density on said developer carrying member by the first magnetic pole is 1500–2500 Gauss and a maximum magnetic flux density on said developer carrying member by the second magnetic pole is 400–1400 Gauss.

9. An apparatus according to claim 8, wherein said resin magnet is provided with a recess in which the rare earth magnet is embedded.

10. An apparatus according to claim 7, 8 or 9, wherein said rare earth magnet comprises at least one of samarium (Sm) and neodymium (Nd).

11. An apparatus according to claim 7, 8 or 9, wherein said resin magnet comprises a resin binder and ferrite particles dispersed therein.

12. An apparatus according to claim 11, wherein said resin magnet comprises a resin binder and ferrite particles dispersed therein.

13. An apparatus according to claim 7, 8 or 9, wherein the second magnetic pole has a magnetization width which is larger than a magnetization width of the first magnetic pole.

* * * * *

UNITED STATES PATENT AND TRADEMARK OFFICE

CERTIFICATE OF CORRECTION

PATENT NO. 5,359,397

DATED October 25, 1994

INVENTOR(S) YAMAJI

It is certified that error appears in the above-indentified patent and that said Letters Patent is hereby corrected as shown below:

COLUMN 1

Line 44, "therein" should read --then--.

COLUMN 2

Line 11, "the" should be deleted.

COLUMN 3

Line 58, "to" (second occurrence) should be deleted.

COLUMN 5

Line 1, "sleeve.21" should read --sleeve 21--.

UNITED STATES PATENT AND TRADEMARK OFFICE

CERTIFICATE OF CORRECTION

PATENT NO. 5,359,397

DATED October 25, 1994

INVENTOR(S) YAMAJI

It is certified that error appears in the above-indentified patent and that said Letters Patent is hereby corrected as shown below:

COLUMN 7

Line 52, "pole Si:" should read --pole S1:--
Line 54, "pole Ni:" should read --pole N1:--

COLUMN 8

Line 25, "the" should be deleted.

Signed and Sealed this

Twenty-first Day of March, 1995

*Attest:*

Bruce Lehman

BRUCE LEHMAN

*Attesting Officer*

*Commissioner of Patents and Trademarks*